US006414422B1

(12) United States Patent
Iwasa et al.

(10) Patent No.: US 6,414,422 B1
(45) Date of Patent: Jul. 2, 2002

(54) COLD CATHODE ELEMENT

(75) Inventors: Takashi Iwasa, Wako; Junzo Ishikawa, Kyoto, both of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/793,953

(22) Filed: Feb. 28, 2001

(30) Foreign Application Priority Data

Mar. 1, 2000 (JP) ..... 2000-060443

(51) Int. Cl.[7] ..... H01J 1/05

(52) U.S. Cl. ..... 313/311; 313/310; 313/309; 315/169.1

(58) Field of Search ..... 313/310, 311, 313/309, 308, 336, 351; 315/169.1, 169.4, 167, 168

(56) References Cited

U.S. PATENT DOCUMENTS 5,650,201 A * 7/1997 Tompa ..... 427/255.394
5,760,563 A * 6/1998 Bennett et al. ..... 318/471
5,852,303 A * 12/1998 Cuomo et al. ..... 204/192.15
5,989,511 A * 11/1999 Gruen et al. ..... 117/108
6,268,686 B1 * 7/2001 Iwasa et al. ..... 313/309
6,278,233 B1 * 8/2001 Sanou et al. ..... 313/292

FOREIGN PATENT DOCUMENTS

JP 2001202870 A * 10/2000
JP 2000285793 A * 7/2001

* cited by examiner

*Primary Examiner*—Haissa Philogene
(74) *Attorney, Agent, or Firm*—Arent Fox Kintner Plotkin & Kahn, PLLC

(57) ABSTRACT

To provide a cold cathode element, which has a high practicability and is capable of emitting electrons sufficiently even at a low voltage applied. The cold cathode element emits electrons by application of an electric field to the element and is formed of an amorphous carbon film, the refractive index n of a surface of the film being equal to or larger than 2.5.

4 Claims, 4 Drawing Sheets

COLD CATHODE ELEMENT

FIELD OF THE INVENTION

The present invention relates to a cold cathode element for emitting electrons by application of an electric field to the element.

BACKGROUND OF THE INVENTION

A hot cathode element and a cold cathode element are conventionally known as an electron-emitting element.

The hot cathode element is used in a field represented by a vacuum tube, but suffers from a problem that it is difficult to integrate, because heat is applied thereto. On the other hand, it is expected that the cold cathode element is applied to a flat panel display, a voltage-amplifying element, a high-frequency amplifying element and the like, as an element capable of being integrated, because no heat is used.

SUMMARY OF THE INVENTION

It is an object of the present invention to provide a cold cathode element of the above-described type, which has a high practicability and which is capable of emitting electrons sufficiently even at a low voltage applied.

To achieve the above object, according to the present invention, there is provided a cold cathode element which emits electrons by application of an electric field to the cold cathode element, and is formed of an amorphous carbon film, the refractive index n of a surface of the film being equal to or larger than 2.5.

The refractive index n is measured by a spectro-ellipsometry and assumes a value at a wavelength of 630 nm. In an amorphous carbon film, the refractive index n of the surface of which is set at a value equal to or larger than 2.5 as described above, the density of atoms forming the amorphous carbon film (which will be referred to as film-forming atoms hereinafter) is higher than that of a conventional diamond-like carbon (DLC) film and as a result, surplus electrons are produced in the amorphous carbon film, whereby the film is brought into a state in which it is difficult for such surplus electrons to be present in the solid. Therefore, the emitted electric field is reduced, whereby electrons can be emitted sufficiently even at a low voltage applied. However, if the refractive index n is smaller than 2.5, the density of the film-forming atoms is reduced. If n>3.0, it is difficult to increase the density of the film-forming atoms due to a repulsive force between the carbon atoms. For this reason, the upper limit value of the refractive index n is set at 3.0 (n=3.0).

The amorphous carbon film can be easily used and can also be used as a material forming a surface film layer on a cold cathode element made of silicon (Si), for example, in order to enhance the performance of the cold cathode element.

DETAILED DESCRIPTION OF THE PREFERRED EMBODIMENTS

Figure 1:
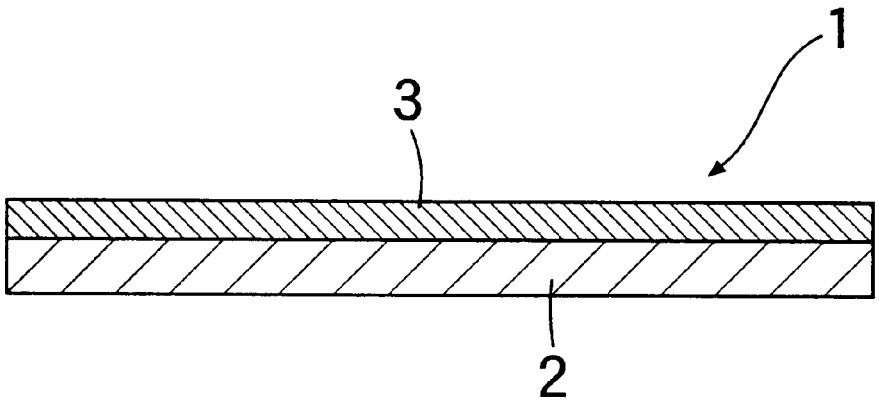
FIG. 1 is a sectional view of a cathode unit.

FIG. 1 shows a cathode unit 1. The cathode unit 1 comprises a cathode plate 2 made of aluminum (Al), and a cold cathode element 3 formed on a surface of the cathode plate 2. The cold cathode element 3 is formed of an amorphous carbon film, and the refractive index n of a surface of the cold cathode element 3 at a wavelength of 630 nm measured at by a spectro-ellipsometry is set at a value equal to or larger than 2.5 ($n \geqq 2.5$).

In the amorphous carbon film having the refractive index n of the surface set as described above, the density of film-forming atoms is higher than that in a conventional diamond-like carbon (DLC) film. As a result, surplus electrons are produced in the amorphous carbon film, whereby the film is brought into a state in which it is difficult for surplus electrons to be present in the solid. Therefore, the emitted electric field is reduced, whereby electrons can be emitted sufficiently even at a lower voltage applied.

The refractive index n measured for a surface of an amorphous carbon film by spectro-ellipsometry is generally smaller than 2.5 ($n<2.5$). The amorphous carbon film in accordance with this embodiment can be formed by an ion beam deposition process using a negative ion beam. Thus, even if the film is amorphous, the density of film-forming atoms in the film can be increased, and the refractive index n of the surface of the film can be set at a value equal to or larger than 2.5 ($n \geqq 2.5$).

This is due to the following reason: The electron affinity ($C^- \rightarrow C + e^- - 1.268$ eV (endothermic reaction)) of the negative ion is equal to or lower than that of an interatomic bond energy (1 to 8 eV), and the neutralization is an endothermic reaction. Therefore, the energy in the ion beam deposition is governed by kinetic energy and thus by deposition energy, whereby the control of the energy can be easily carried out to reduce the distance between bonded atoms.

On the other hand, the ionized potential energy ($C^- + e^- \rightarrow C + 11.26$ eV (exothermic reaction)) of the positive ion is remarkably larger than that of the interatomic bond energy (1 to 8 eV) and hence, a surplus energy is produced during the ion beam deposition and increases the repulsive force acting between the atoms. Therefore, the distance between the bonded atoms is increased, namely, the density of the film-forming atoms is reduced.

Particular examples will be described below.

(I) Formation of Amorphous Carbon Film by Negative Ion Beam Deposition Process

Figure 2:
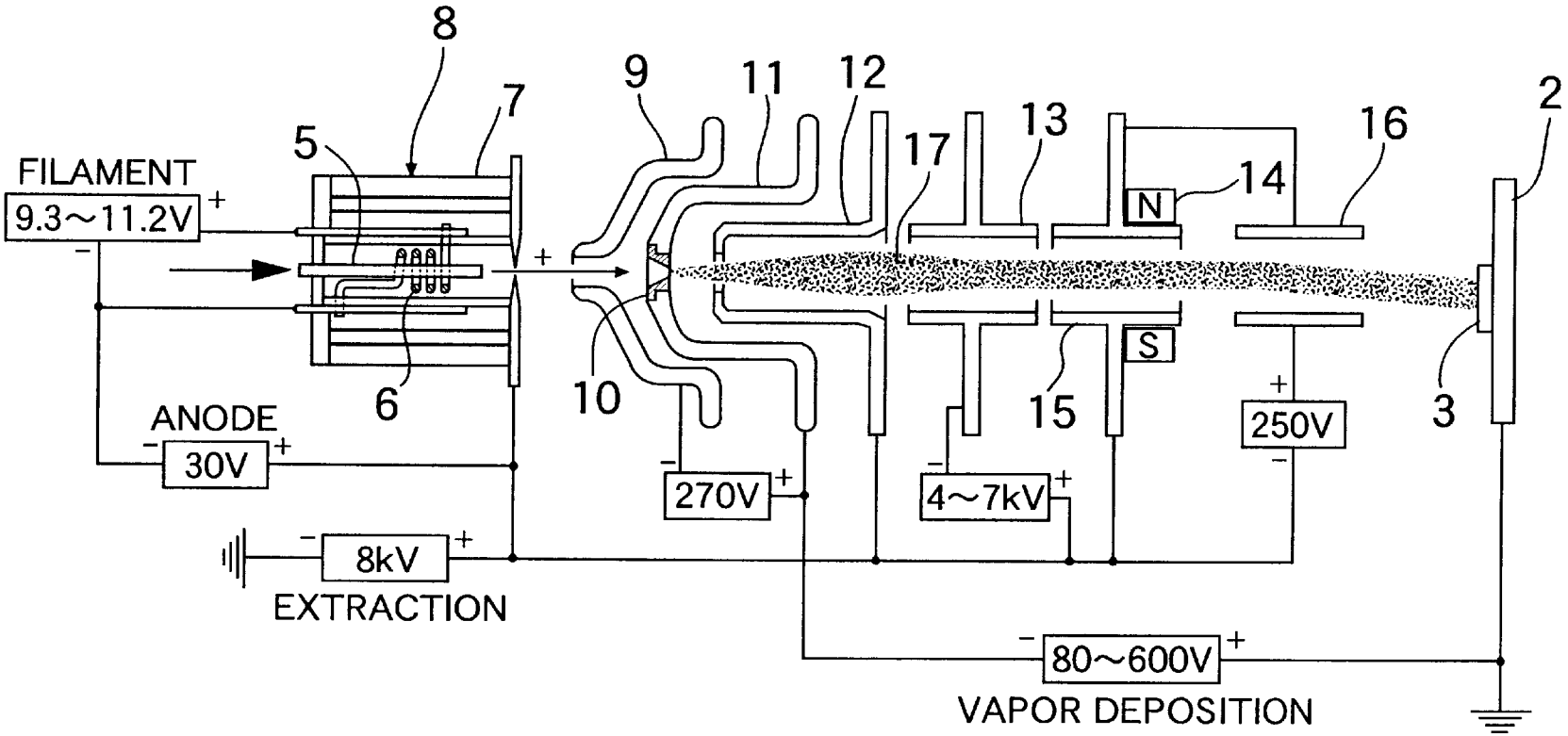
FIG. 2 is a diagrammatic illustration of a neutral and ionized alkaline metal bombardment type heavy negative ion source apparatus.

FIG. 2 shows a conventional neutral and ionized alkaline metal bombardment type heavy negative ion source apparatus (NIABNIS). This apparatus includes a Cs plasma ion source 8 having a center anode pipe 5, a filament 6, a heat shield 7 and the like; a suppressor 9; a target electrode 11 provided with a target 10 made of high-purity and high-density carbon; a negative ion extracting electrode 12; a lens 13; an electron removing member 15 having a magnet 14; and a deflecting plate 16.

To form the amorphous carbon film 3 (the same reference numeral as the cold cathode element is used for convenience), a process was employed which involves (a) applying a predetermined voltage to each of various portions, as shown in FIG. 2, (b) generating positive ions of Cs by the Cs plasma ion source 8, (c) sputtering the target 10 by the positive ions of Cs to generate negative ions of C and the like, (d) extracting negative ions by the negative ion extracting electrode 12 through the suppressor 9 to generate a negative ion beam 17, (e) focusing the negative ion beam 17 by the lens 13, (f) removing electrons contained in the negative ion beam 17 by the electron removing member 15, and (g) allowing only the negative ions to travel toward the cathode plate 2 by the deflecting plate 16.

Figure 3:
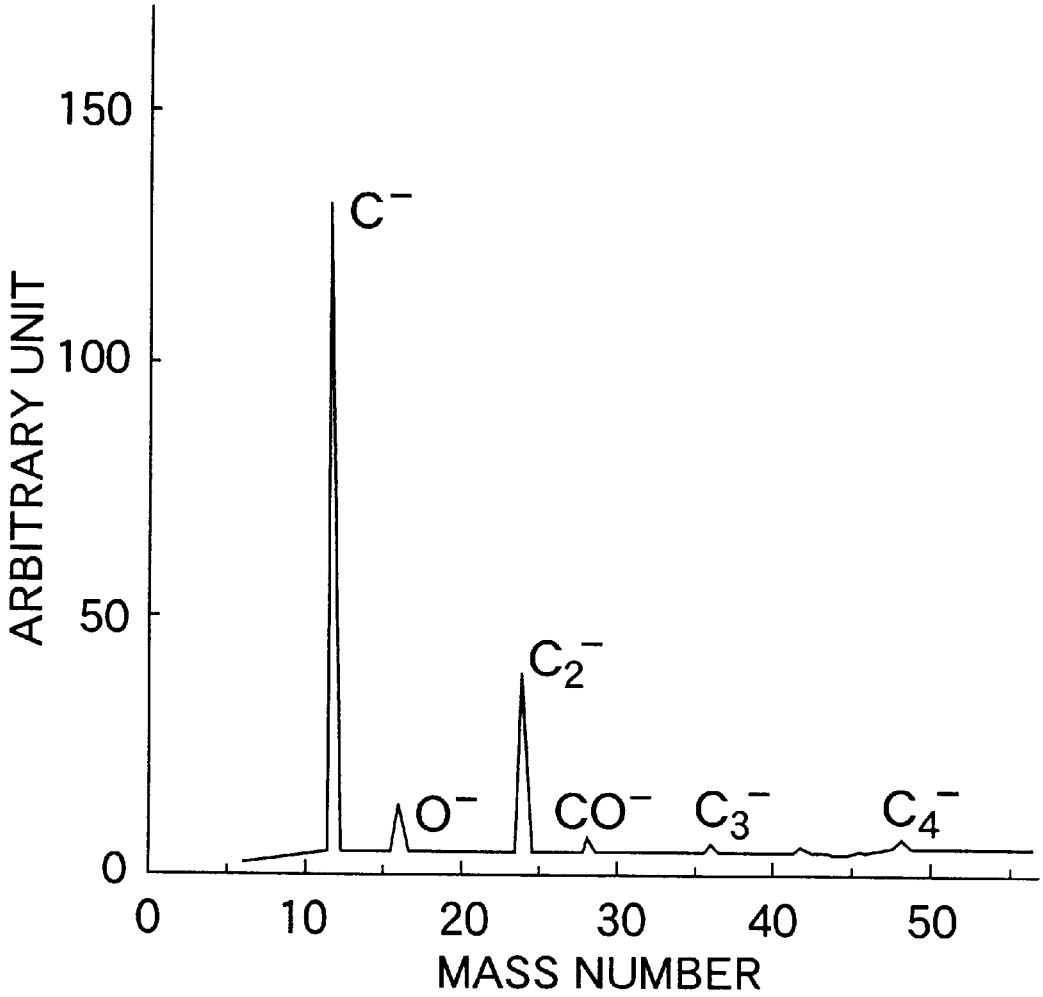
FIG. 3 is a beam spectrum provided by the apparatus.

FIG. 3 shows a mass spectrum for the negative ion beam 17. Main negative ions in the negative ion beam 17 are $C^-$ ions with a number of forming atoms equal to 1, and $C_2^-$ ions with a number of forming atoms equal to 2, but the ion current of $C^-$ is larger than that of $C_2^-$.

Table 1 shows forming conditions in examples 1 to 5 of an amorphous carbon film 3 formed by the negative ion beam deposition process. The thickness of each of examples 1 to 5 was 0.4 to 0.8 $\mu$m.

TABLE 1

| Amorphous carbon film | Deposition voltage (V) | Extracting voltage (kV) | Voltage-current of filament (V-A) |
|---|---|---|---|
| Example 1 | 80 | 8 | 9.5–20.3 |
| Example 2 | 200 | 8 | 11.1–20.2 |
| Example 3 | 300 | 8 | 11.2–20.8 |
| Example 4 | 600 | 8 | 9.3–19.0 |
| Example 5 | 500 | 8 | 10.7–20.2 |

Then, the analysis using a Raman spectroscopy was carried out for a substantially central portion of each of examples 1 to 5 to determine whether each of them was amorphous. As a result, broad Raman bands principally having a predetermined number of waves were observed. From this, it was ascertained that examples 1 to 5 were amorphous.

The refractive index n of each of the surfaces of examples 1 to 5 was measured by the spectro-ellipsometry, whereby a value at a wavelength of 630 nm was determined.

Figure 4:
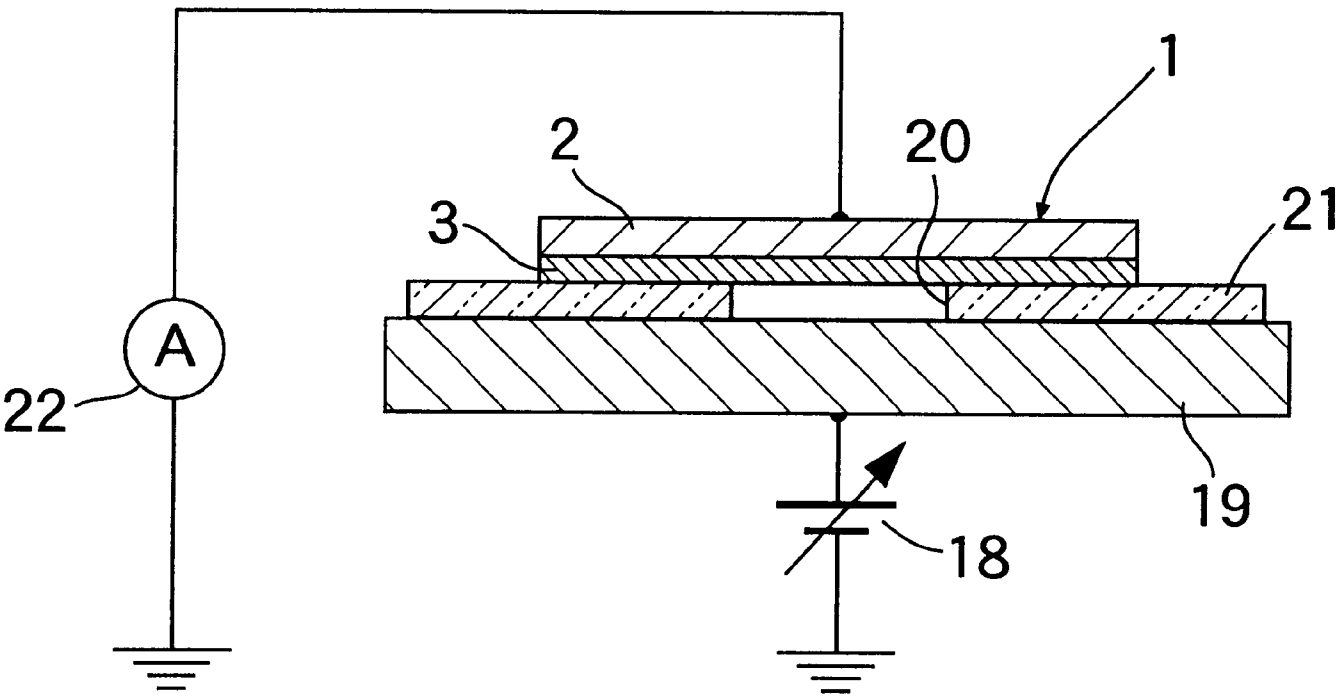
FIG. 4 is a diagram for explaining an emitted-electric field measuring process.

Further, the measurement of an emitted electric field of each of examples 1 to 5 was carried out by a process shown in FIG. 4. More specifically, a conductive plate 19 made of aluminum was connected to a power supply 18 whose voltage can be adjusted, and a cover glass 21 having a thickness of 150 $\mu$m and centrally provided with an opening 20 having a length of 0.8 cm long and a width of 0.8 cm (an area of 0.64 $cm^2$), was placed onto the conductive plate 19. The amorphous carbon film 3 of the cathode unit 1 was placed onto the cover glass 21 and further, an ammeter 22 was connected to the cathode plate 2. Then, a predetermined voltage was applied from the power source 18 to the conductive plate 19, and a current was read by the ammeter 22. An emitted current density ($\mu A/cm^2$) was determined from the measured current and the area of the opening 20, and considering a practicability, when the emitted current density reached 8 $\mu A/cm^2$, an emitted electric field ($V/\mu m$) was determined from the corresponding voltage and the thickness of the cover glass 21.

Table 2 shows the refractive index n of the surface and the emitted electric field for each of examples 1 to 5.

TABLE 2

| Amorphous carbon film | Refractive index n | Emitted electric field ($V/\mu m$) |
|---|---|---|
| Example 1 | 2.45 | 3.21 |
| Example 2 | 2.47 | 3.12 |
| Example 3 | 2.49 | 2.48 |
| Example 4 | 2.51 | 1.23 |
| Example 5 | 2.62 | 0.91 |

As is apparent from Table 2, if the refractive index n of the surface is set at a value equal to or larger than 2.5 ($n \geqq 2.5$) as in examples 4 and 5, the emitted electric field can be reduced by 50% or more, as compared with a surface having a refractive index n smaller than 2.5.

The cold cathode element of this type can be applied to, for example, a flat panel display, a voltage amplifying element, a high-frequency amplifying element, a high-accuracy close-distance radar, a magnetic sensor, and a visual sensor and the like.

According to the present invention, it is possible to provide a cold cathode element which has a high practicability and is capable of emitting electrons sufficiently even at a low voltage applied, by forming the cold cathode element in the above-described manner.

What is claimed is:

1. A cold cathode element which emits electrons by application of an electric field to the cold cathode element, and is formed of an amorphous carbon film, the refractive index n of a surface of the film being equal to or larger than 2.5.

2. A cold cathode element according to claim 1, wherein the upper limit value of said refractive index n is equal to 3.0.

3. A cold cathode element according to claim 1, wherein said amorphous carbon film is formed by an ion beam deposition process using a negative ion beam.

4. A cold cathode element according to claim 2, wherein said amorphous carbon film is formed by an ion beam deposition process using a negative ion beam.

* * * * *